US007918619B2

(12) United States Patent
Gueret

(10) Patent No.: US 7,918,619 B2
(45) Date of Patent: Apr. 5, 2011

(54) PACKAGING AND APPLICATOR DEVICE, AND METHOD OF MAKING UP SKIN OR LIPS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1108 days.

(21) Appl. No.: 11/439,183

(22) Filed: May 24, 2006

(65) Prior Publication Data

US 2007/0020027 A1 Jan. 25, 2007

Related U.S. Application Data

(60) Provisional application No. 60/688,361, filed on Jun. 8, 2005.

(30) Foreign Application Priority Data

May 24, 2005 (FR) ..... 05 51353

(51) Int. Cl.
*B43M 11/00* (2006.01)

(52) U.S. Cl. ..... 401/128; 401/122; 401/126

(58) Field of Classification Search ..... 401/122, 401/126–130

See application file for complete search history.

(56) References Cited

U.S. PATENT DOCUMENTS

| | | | | |
|---|---|---|---|---|
| 2,168,179 | A | 8/1939 | Tobey | |
| 3,692,417 | A | 9/1972 | Aston | |
| 4,194,848 | A * | 3/1980 | Kingsford | 401/5 |
| 4,411,282 | A | 10/1983 | Wavering | |
| 4,437,477 | A | 3/1984 | Gueret | |
| 4,974,498 | A | 12/1990 | Lemelson | |
| 4,974,980 | A | 12/1990 | Gueret | |
| 5,542,439 | A | 8/1996 | Gueret | |
| 5,761,760 | A | 6/1998 | Dumler et al. | |
| 5,803,638 | A * | 9/1998 | Gueret | 401/122 |
| 5,826,600 | A | 10/1998 | Rowe et al. | |
| 5,888,005 | A | 3/1999 | Gueret | |

(Continued)

FOREIGN PATENT DOCUMENTS

CN 1175189 A 3/1998

(Continued)

OTHER PUBLICATIONS

Office Action issued in U.S. Appl. No. 12/656,144 on May 19, 2010.

(Continued)

*Primary Examiner* — David J Walczak
(74) *Attorney, Agent, or Firm* — Oliff & Berridge, PLC

(57) ABSTRACT

A packaging and an applicator device may include: a receptacle containing a composition for application; and an applicator for applying the composition contained in the receptacle. The applicator may include: a stem; and an applicator element at one end thereof. The applicator element may project laterally from the stem, and may include at least two branches of plastics material, with at least one of the branches being flocked at least in part. The branches may meet at ends thereof and define between the ends a cavity that is open to the outside via a face of the applicator element that is configured to apply the composition. The cavity may be elongate in shape and may extend along the branches. The branches may be sufficiently rigid to prevent the cavity from deforming substantially between a moment when the applicator element leaves the composition and a moment when the composition is applied.

47 Claims, 8 Drawing Sheets

U.S. PATENT DOCUMENTS

| | | | | |
|---|---|---|---|---|
| 5,913,318 | A | 6/1999 | Gueret | |
| 6,033,143 | A | 3/2000 | Gueret | |
| 6,067,997 | A | 5/2000 | Gueret | |
| 6,120,202 | A | 9/2000 | Donsky | |
| 6,220,254 | B1 | 4/2001 | Gueret | |
| 6,305,861 | B1 | 10/2001 | Gueret | |
| 2001/0033766 | A1 | 10/2001 | Gueret | |
| 2002/0005209 | A1 | 1/2002 | Gueret | |
| 2003/0235454 | A1 | 12/2003 | Gueret | |
| 2004/0018037 | A1* | 1/2004 | Gueret | 401/126 |

FOREIGN PATENT DOCUMENTS

| | | | |
|---|---|---|---|
| CN | 1238931 | A | 12/1999 |
| CN | 2566685 | Y | 8/2003 |
| EP | 0 693 263 | A1 | 1/1996 |
| EP | 0 875 169 | A1 | 11/1998 |
| EP | 0 963 715 | B1 | 12/1999 |
| EP | 0 824 329 | B1 | 7/2002 |
| EP | 0 792 602 | B1 | 12/2002 |
| EP | 1 336 353 | A1 | 8/2003 |
| EP | 1 053 695 | B1 | 4/2004 |
| FR | 2412287 | | 7/1979 |
| FR | 2 771 077 | | 5/1999 |

OTHER PUBLICATIONS

U.S. Appl. No. 12/656,144 filed, Jan. 19, 2010.

* cited by examiner

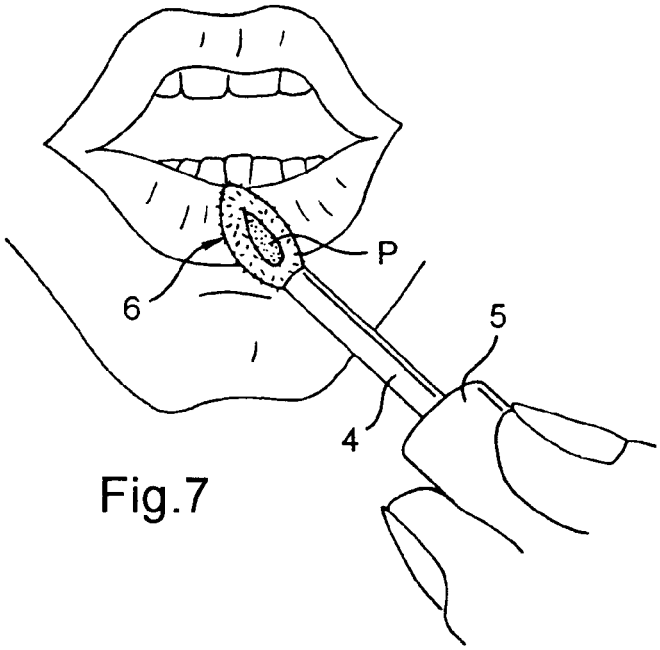
Fig.7
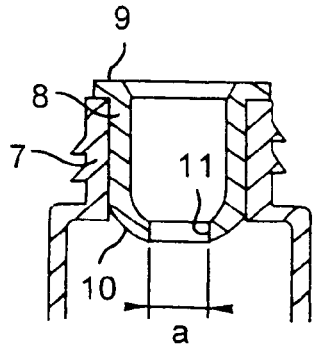
Fig.6
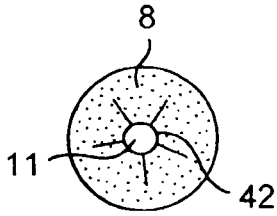
Fig.9
Fig.8
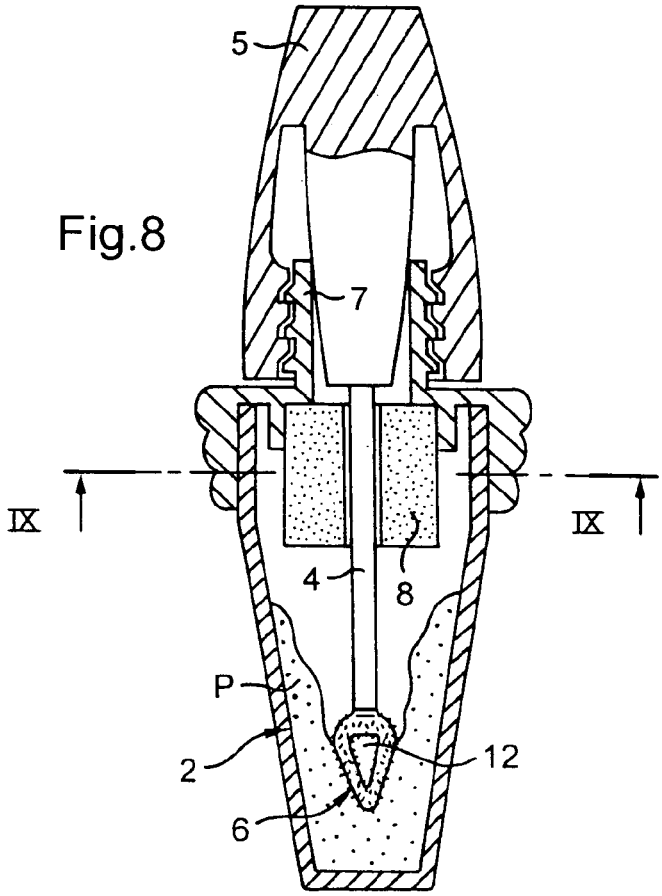
Fig.10
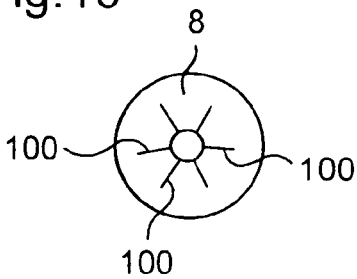

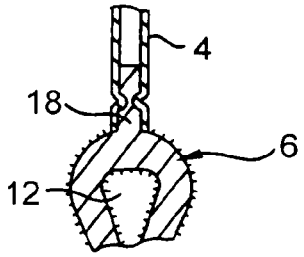
Fig.11
Fig.12
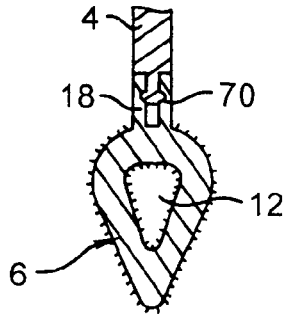
Fig.13
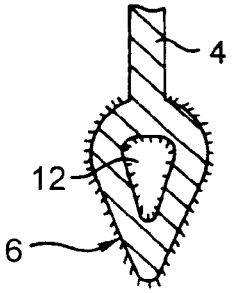
Fig.14
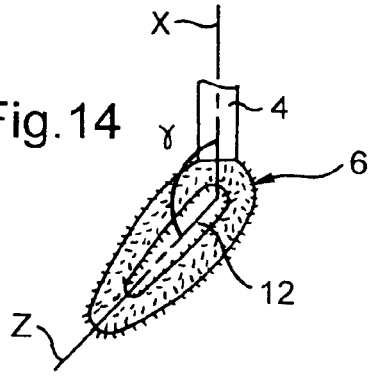
Fig.15
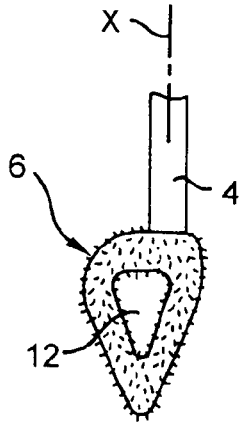
Fig.16
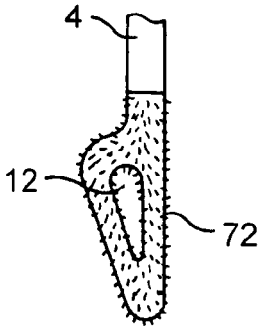
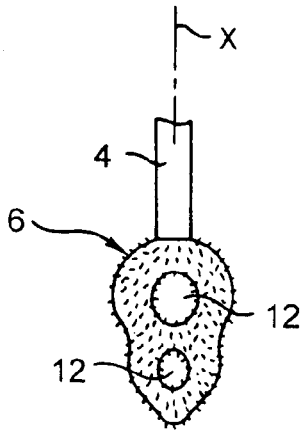
Fig.17

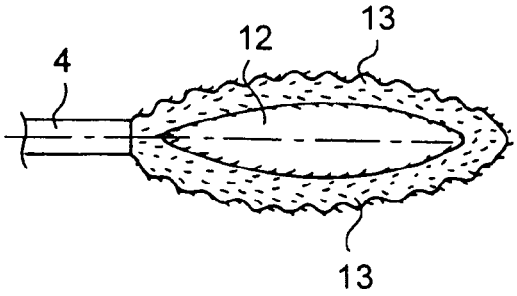
Fig.33
Fig.34
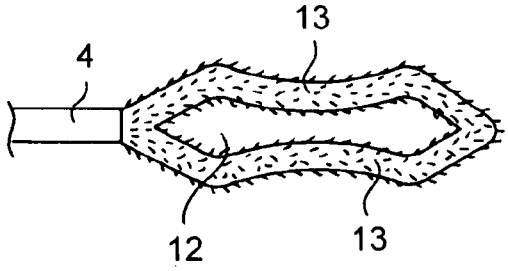
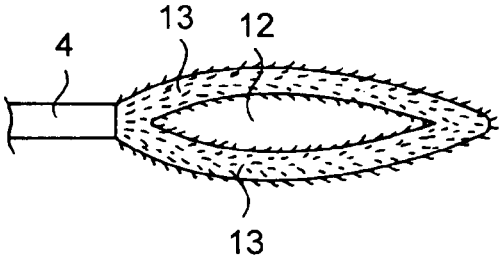
Fig.35
Fig.36
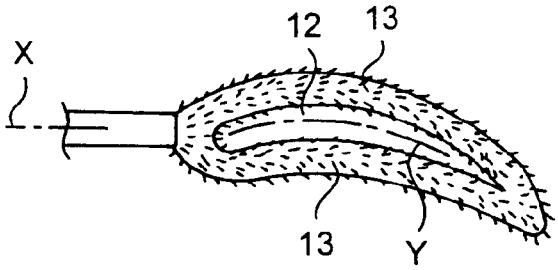
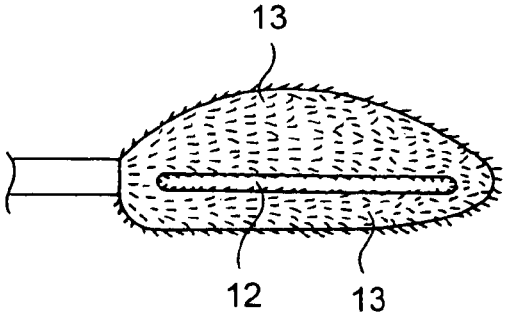
Fig.37
Fig.38
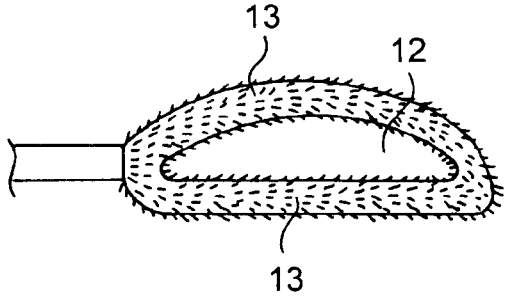

Fig.48
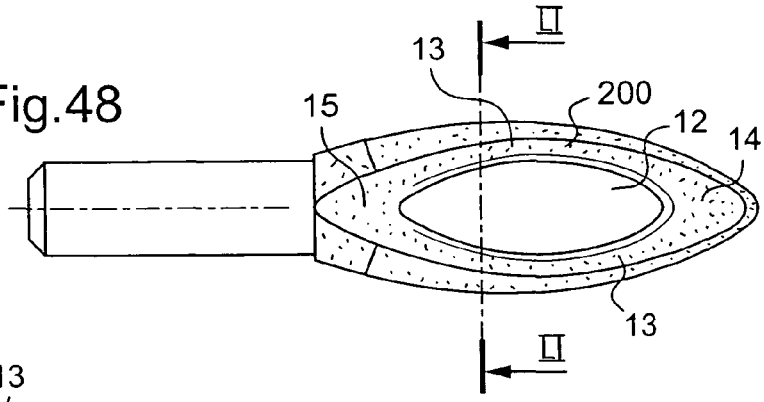
Fig.49
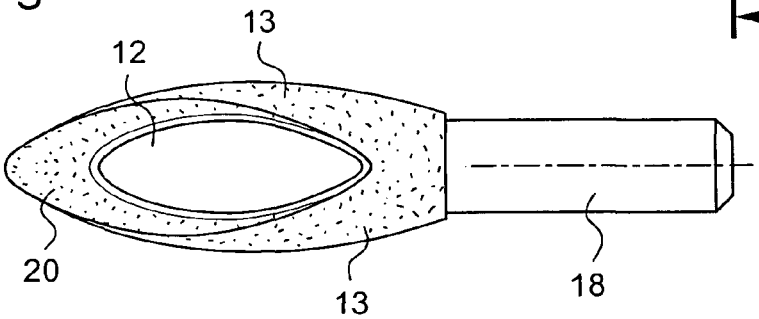
Fig.50
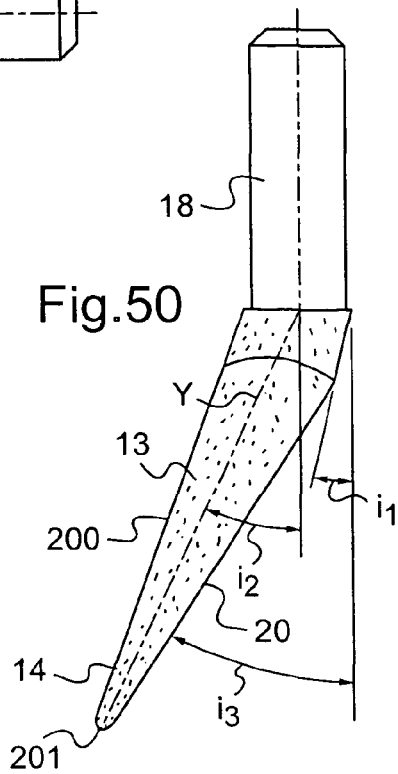
Fig.51
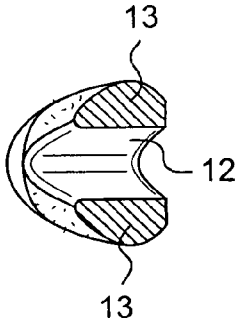
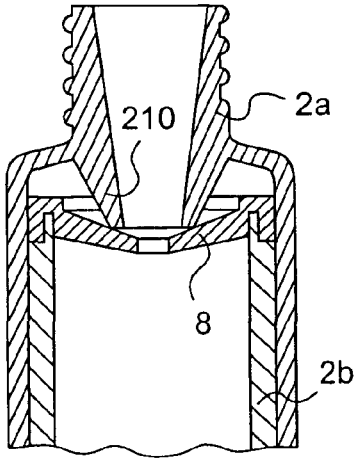
Fig.52
Fig.53
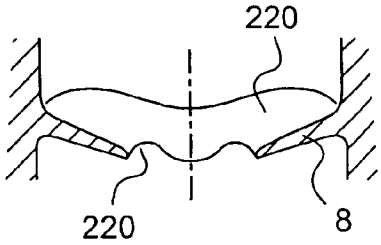

PACKAGING AND APPLICATOR DEVICE, AND METHOD OF MAKING UP SKIN OR LIPS

CROSS-REFERENCE TO RELATED APPLICATION

This non-provisional application claims the benefit of French Application No. 05 51353 filed on May 24, 2005, and U.S. Provisional Application No. 60/688,361 filed on Jun. 8, 2005, the entire disclosures of which are incorporated herein by reference.

BACKGROUND

The present invention relates to applicators for cosmetic compositions, including care products.

European patent EP 0 792 602-B1 discloses an applicator comprising a flexible support forming an applicator portion that is covered at least in part by at least one layer of spongy material. Such an applicator is used differently from conventional applicators comprising an applicator member placed at the end of a stem and in which the applicator member is loaded with composition by being immersed in a receptacle, possibly provided with a wiper member.

U.S. Pat. No. 6,120,202 discloses a device that enables two decorative patterns to be made simultaneously on the nails. The device comprises an applicator with two stems each provided at one end with an applicator member provided with a circular recess.

European patent application EP 0 875 169-A1 discloses an applicator comprising an applicator member having a block of foam that is flocked at one end. The side surface of the applicator member is striped.

European patent EP 0 824 329-B1 describes a packaging and applicator device including a wiper member made at least in part of cellular material. In an embodiment, the applicator member is in the form of a hollow body including a cavity suitable for housing a supply of composition.

French patent application FR 2 771 077 also describes a packaging and applicator device including a wiper member constituted at least in part by an elastically-deformable porous material. In an embodiment, the applicator member has slots that are sufficiently narrow to make it difficult for the wiper member to reach them, serving to retain a supply of composition inside the applicator member after the applicator member has been wiped.

European patent EP 1 053 695-B1 discloses an applicator including an applicator member capable of deforming on going past a wiper member. The applicator surface is relatively narrow and comfort in application is not entirely satisfactory.

European patent application EP 0 693 263-A1 discloses an applicator including a stem having at an end thereof an applicator member comprising a loop with two ends that are connected separately to the stem. Such an applicator is intended more particularly for applying nail varnish, and the stem includes flexibility similar to that of the applicator member.

U.S. Patent Application Publication No. 2002/0005209 discloses an applicator for applying a composition on eyelashes or eyebrows. The applicator comprises branches that are united at ends thereof and that carry projecting elements that might be flocked.

U.S. Pat. No. 4,974,980 discloses an applicator member with a cross-section inscribed in the cross-section of the stem, when the applicator is observed along the longitudinal axis of the stem. In other words, the applicator member does not project laterally out of the stem.

SUMMARY

Exemplary embodiments of the invention seek to provide a novel applicator that enables makeup to be applied neatly, that is comfortable to use, and/or that is capable of storing a relatively large quantity of composition.

Exemplary embodiments of the invention may provide a packaging and applicator device comprising: a receptacle containing a composition for application; and an applicator for applying the composition contained in the receptacle. The applicator may comprise a stem and an applicator element at one end of the stem. The applicator element preferably include a shape that is generally flat, comprising at least two branches of plastics material, preferably injection-molded plastics material, that meet at ends thereof and that define therebetween a cavity that is open to the outside, for example, in at least one face of the applicator element that is used for applying the composition. At least one of the branches may be flocked at least in part. The cavity may be elongate in shape and may extend along the branches. The branches may be sufficiently rigid to prevent the cavity from deforming substantially between a moment when the applicator element leaves the composition and a moment when the composition is applied. The absence of substantial deformation of the cavity may make it possible to avoid any composition being expelled therefrom. The branches of the applicator element may not be substantially deformed during the application of the composition, where appropriate or desired.

When the applicator element goes through a wiper member between the moment when the applicator element leaves the composition and the moment when the composition is applied, the absence of deformation of the cavity may result from using a wiper member that is sufficiently flexible not to deform the applicator element too much, for example, a wiper member comprising an undulating lip, or may result from a particular adjustment of an adjustable wiper member.

In such exemplary embodiments, a different adjustment of the wiper member may result in a possible deformation of the cavity.

In exemplary embodiments, at least one of the branches may include a coating of flocking on at least half of its length, for example, or better over its entire length.

Prior to application, the cavity may be completely or partially filled with composition. The composition in the cavity may come directly into contact with a surface being treated.

The composition may be liquid, for example, for application to lips, skin, nails, or keratinous fibers, such as the eyelashes or eyebrows. The composition may also be in a solid or powder form, for example, in the form of a cake, optionally needing to be moistened to enable the composition to be taken.

The composition may be packaged in a receptacle provided with a wiper member, for example, made of a non-cellular material, for example, an elastomer, which may make it possible to leave more composition in the cavity. For example, the wiper member may include one or more slots.

The cavity may serve to constitute a supply of composition that enables the applicator element to continue being used for a relatively longer time, or that makes it easier to deposit a larger quantity of composition, to reinforce a makeup effect, for example, the color or the brightness of a composition applied to the lips, for example, the brightness of a lip gloss.

Application may also take place on the nails or on keratinous fibers, for example, on the eyelashes and/or the eyebrows, for makeup or care purposes.

In exemplary embodiments in which only a portion of the applicator element is flocked, it may be possible, for example, for the user to select a particular branch, end, side, or face of the applicator element that is flocked or that is not flocked as a function of a desired makeup result.

At least one of the branches may include a cross-section that is at least partially round in shape. Such a shape may improve comfort during application and may reduce a risk of the applicator element removing any previously-applied composition as the applicator element moves over a region to which the applicator element is applying makeup. For example, at least one of the branches may include a cross-section that is circular, oval, or elliptical in shape. Alternatively, at least one of the branches may include a cross-section that is substantially triangular, square, or rectangular in shape.

Each branch may include a longitudinal axis that is substantially rectilinear or curvilinear, or possibly wavy.

At least one of the branches may include a dimension in cross-section that is greater than a width of the cavity, for example, a width or a height that is greater than the width of the cavity.

The cavity may include a maximum width that is greater than a diameter of the stem.

The applicator element, or even the entire applicator, may be made without using any metal, thus making it possible for the applicator element and/or applicator to be heated in a microwave oven, for example.

The shape of the applicator element may depend, for example, on the region of the body or the face onto which the composition is to be applied.

With the lips, for example, the cavity may advantageously extend substantially parallel to a plane forming a non-zero angle with the longitudinal axis of a stem to which the applicator element is connected. At least a portion of the applicator element may thus be elongate along a longitudinal axis that forms a non-zero angle with the longitudinal axis of the support stem. The longitudinal axis of the applicator element may also coincide substantially with the axis of the stem that carries the applicator element.

The applicator element may include a envelope surface that is circularly symmetrical, or otherwise. The applicator element may include a shape that is symmetrical about a midplane, for example, a midplane containing the longitudinal axis of the support stem. An end of the support stem that is remote from an end thereof carrying the applicator element may be connected to a cap for closing the receptacle.

From the stem to which the applicator member is connected, a width of the applicator member may increase and then decrease toward a distal end of the applicator member. The width of the applicator member may thus be greater than, in at least one point of its length, for example, in more than one-fourth or half of the length, a diameter of the stem. The applicator element may comprise at least a longitudinal side which is laterally outwardly offset relatively to the stem. The applicator element may thus project laterally from the stem on at least one side.

The applicator element may project laterally from the stem, thanks to a width which is greater than that of the stem and/or thanks to a direction in which the applicator element projects.

A distance from which the applicator element projects from the stem may correspond, for example, to the length of fibers of a flocking or may be greater.

A thickness of material, around the cavity, at least in a distat half of the applicator element, may be non-constant, on account, for example, of a thicker region formed at a junction of the branches.

The applicator element may include a single tip centered on a median axis, for example, conferring more precision to the make-up.

The applicator element need not include any portions in relief of elongate shape, such as spikes or teeth molded integrally, i.e., monolithically, with the branches of the applicator element and projecting therefrom.

As mentioned above, the receptacle may include a wiper member fitted thereto, for example, secured in a neck of the receptacle. Alternatively, the receptacle does not include a wiper member. A smallest cross-section of an opening of the receptacle may be circular, regardless of whether the receptacle includes a wiper member fitted thereto.

The applicator element may be secured to the stem in various ways, and, for example, the applicator element may include a fastener endpiece engaged in the stem. The applicator element may include an endpiece that is crimped in the stem or snap-fastened therein or thereon. Instead of being fitted to the stem, the applicator element may also be made at least in part integrally, i.e., monolithically, with the stem.

The stem may include an outside diameter that is greater than or equal to 2.5 millimeters (mm), better that is greater than or equal to 3 mm, and, for example, that is about 4 mm, thus giving the stem a certain amount of rigidity, for example, to improve the precision with which makeup is applied.

The cavity may extend over more than half of a width of the applicator element.

A width of the cavity may be less than a width of the two branches together. The cavity may extend through the applicator element on more than half of a length of the cavity.

The cavity may not be constant in width and, for example, may be generally triangular in shape. In exemplary embodiments in which the cavity does not extend through the applicator element and the applicator element comprises a membrane that is molded as a single piece with the branches or that is fixed to the branches, a thickness of the membrane may be less than or equal to 1 mm.

The cavity may extend over more than half the length of the applicator element.

The applicator element may include magnetic properties. For example, the applicator element may include magnetic particles.

The applicator element may include proximal and distal portions that are shaped to make it easier to pass through the wiper member when such a member is included. For example, the distal portion may taper away from the stem.

The applicator element may include more than two branches, with at least one branch including a longitudinal axis that is not parallel to a longitudinal axis of the applicator element.

Exemplary embodiments of the invention may provide the applicator considered in isolation, independently of the receptacle and the wiper member that may be associated therewith. For example, such an applicator may be used for associating with a supply of composition that is not necessarily contained in a receptacle with a neck through which the applicator needs to be inserted. For example, the supply of composition may be a mass of composition in the form of a cake or of compacted powder, possibly contained in a cup.

For example, in exemplary embodiments in which the composition is for application to keratinous fibers, for example, eyelashes or eyebrows, the two branches of the applicator element may include shapes that are different, for example. The same may apply in exemplary embodiments in which the composition is for application to lips, for makeup or care purposes.

For example, one of the branches may be thicker, thereby enabling the cavity to be shifted off-center. There may be only one cavity.

The cavity may be relatively elongate in shape, with a ratio m/n that is greater than or equal to 3, or 4, or 5, or 6, for example, where m designates a length of the cavity and n designates a greatest width of the cavity. A relatively narrow shape for the cavity may enhance retention of the composition, for example.

The width of the cavity may pass through an extremum between two free ends thereof, with the extremum being a maximum, for example. The cavity may extend along a longitudinal axis that does not coincide with that of the stem, for example, an axis that is parallel thereto, but offset, or an axis that is curvilinear.

The branches may include a longitudinal outside edge that is outwardly convex, or outwardly concave, or substantially rectilinear over at least a fraction of a length thereof, for example, about halfway along the length.

The applicator element may include a first branch with an outside edge that is convex at least in part toward the outside, and a second branch with an outside edge that is concave or rectilinear, at least in part.

Alternatively, the applicator element may include a first branch with an outside edge that is outwardly concave, at least in part, and a second branch with an outside edge that is outwardly concave or rectilinear, at least in part.

The outside edge of at least one of the branches may be grooved, at least in part.

The branches may be molded together of a thermoplastic material and may be flocked at least in part, after being molded.

The branches may meet each other on a side of the stem before reaching the stem, on going toward the stem.

The applicator element may include flocking bristles including lengths and/or diameters that differ, for example, longer bristles close to the distal end of the applicator element, thus enabling short eyelashes to be made up, for example. The bristles may be of different materials.

Exemplary embodiments of the invention may provide a packaging and applicator device for a composition for application to eyelashes and/or eyebrows, the device comprising: a receptacle containing the composition; and an applicator for applying the composition on the eyelashes and/or the eyebrows, the applicator comprising: a stem; and an applicator element at the end of the stem. The applicator element may comprise at least two branches of plastics material, preferably of injected-molded plastics material, united at their ends and defining therebetween a cavity. The applicator element may not include any portions in relief of elongate shape such as spikes or teeth projecting between the branches.

Such a device offers several possibilities for applying makeup or treating the eyelashes and/or the eyebrows, for example applying the composition on a side by using one of the branches of the applicator individually, on its own or applying the composition flat by using both branches. A number of branches may be two only, for example. The branches need not be striped.

Such an applicator may optionally be flocked, for example, using a mixture of bristles, for example, bristles of different diameters and/or lengths. For example, the flocking may extend over at least one of the branches, for example, over substantially an entire length of the branch(es). The flocking bristles may also be of different materials. For example, the distal portion of the applicator element may thus carry flocking of bristles that are longer and/or at a greater density so as to make it easier to apply makeup to short eyelashes, for example.

Exemplary embodiments of the invention may provide an applicator comprising: a stem; an applicator element including a first end secured to the stem and a second end that is free; and at least three branches made by molding a plastics material and covered at least in part in flocking.

A distance between the first and second ends may be constant. Therebetween, the three branches may define a cavity that may be filled with composition.

Such an applicator may be used, for example, for makeup or care purposes on skin, mucous membranes, nails, or keratinous fibers, such as eyelashes or eyebrows.

Exemplary embodiments of the invention may provide a method of making up skin or lips using a device as defined above, in which a composition is applied to skin or lips using an applicator comprising a stem and an applicator element at one end of the stem, the applicator element comprising at least two branches of plastics material, for example, of injected-molded plastics material, with at least one branch being flocked at least in part, the branches meeting at ends thereof and defining therebetween a cavity that opens to the outside in at least one face of the applicator element that is used for applying the composition, the cavity being elongate in shape and extending along the branches, the branches being sufficiently rigid to prevent the cavity from deforming substantially between a moment when the applicator element leaves the composition and a moment when the composition is applied.

BRIEF DESCRIPTION OF THE DRAWINGS

Various details of the present invention may will be better understood on reading the following detailed description of non-limiting embodiments, and on examining the accompanying drawings, in which:

FIG. 6 shows an exemplary top portion of the receptacle of FIG. 1, in isolation;

FIG. 7 illustrates an exemplary use of the applicator for applying a composition to lips;

FIG. 8 illustrates the possibility of using a wiper member made at least in part of a cellular material;

FIG. 9 is a cross-sectional view taken along IX-IX in FIG. 8, showing the wiper member in isolation;

FIG. 10 is an end view showing part of an exemplary wiper member;

FIGS. 11 to 13 are views analogous to FIG. 5 illustrating various ways of securing the applicator element to the stem;

FIGS. 14 to 17 are views analogous to FIG. 2 showing various exemplary applicator elements;

FIGS. 30 to 41 are views from above of other exemplary applicator elements;

FIG. 48 is a top view of another exemplary applicator element;

FIG. 49 is a bottom view of the applicator element of FIG. 48;

FIG. 50 shows the applicator element in elevation;

FIG. 51 is a cross-sectional view taken along LI-LI in FIG. 48;

FIG. 52 is a diagrammatic longitudinal cross-sectional view of an exemplary receptacle; and FIG. 53 shows in a diagrammatic cross-sectional view of an exemplary wiper member.

DETAILED DESCRIPTION OF EMBODIMENTS

Figure 1:
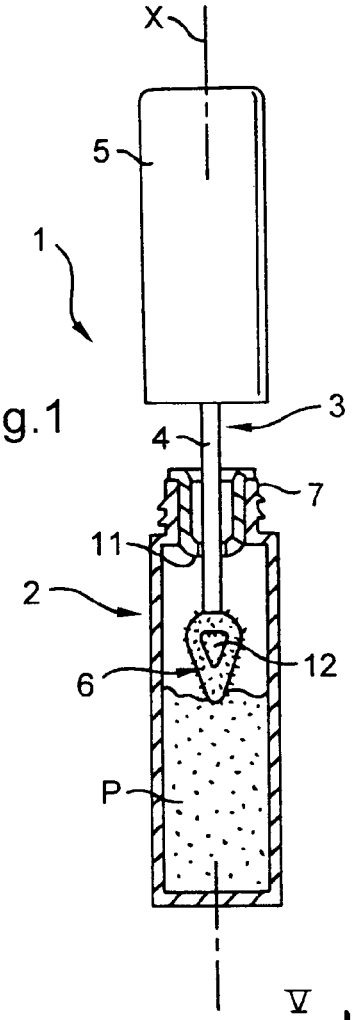
FIG. 1 is a diagrammatic and fragmentary longitudinal cross-sectional view of an exemplary packaging and applicator device.

The exemplary packaging and applicator device 1 shown in FIG. 1 may comprise a receptacle 2 containing a composition P for application, and an applicator 3 comprising a stem 4 of longitudinal axis X, provided at a first end with a handle element 5 that also constitutes a cap configured to close the receptacle 2 in a leaktight manner, and provided at an end thereof with an applicator element 6.

In the exemplary embodiment, the axis X of the stem 4 may be rectilinear; however, alternatively, the axis X of the stem 4 may be curved.

The receptacle 2 may be provided at a top end thereof with a neck 7 that does not include a wiper member fitted thereto.

The handle element 5 may be screwed onto the neck 7; but, alternatively, the handle element 5 may be fastened in some other way, for example, by snap-fastening.

Figure 2:
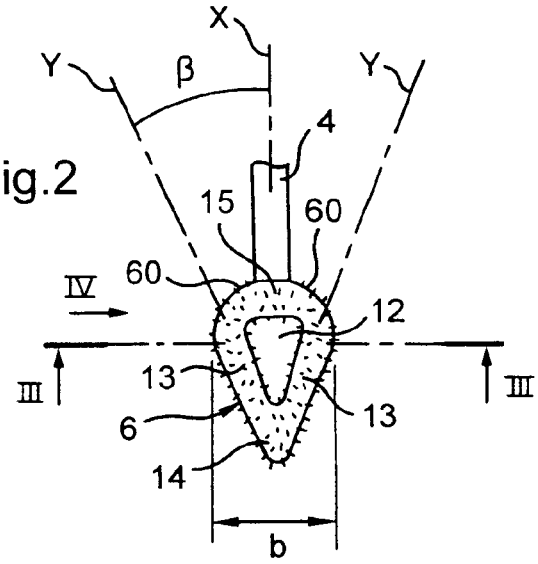
FIG. 2 shows the applicator element of FIG. 1 in isolation.
Figure 3:
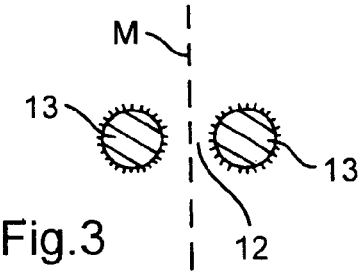
FIG. 3 is a cross-sectional view taken along III-III in FIG. 2.
Figure 4:
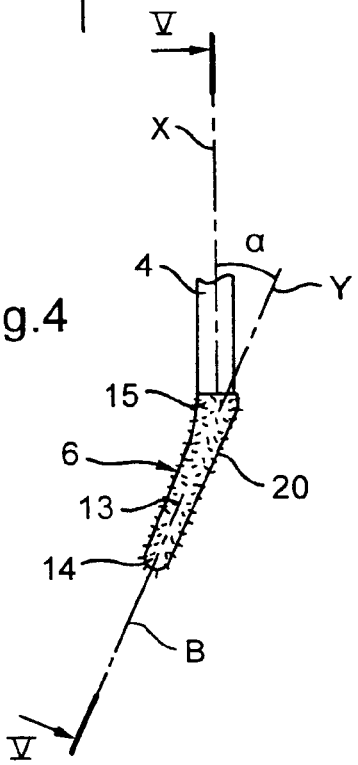
FIG. 4 is a side view seen looking along arrow IV in FIG. 2.
Figure 5:
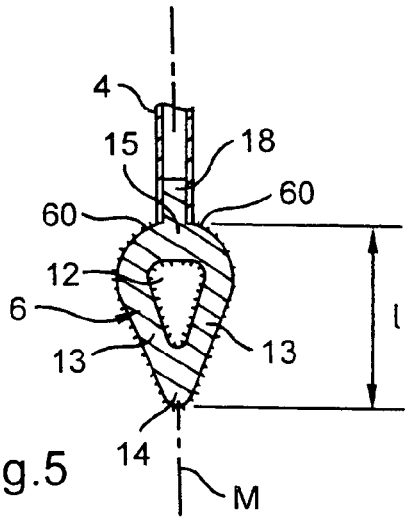
FIG. 5 is a longitudinal cross-sectional view of the applicator element taken along V-V in FIG. 4.
Figure 18:
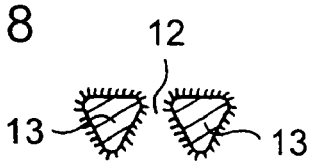
FIGS. 18 to 25 and 27 are cross-sectional views analogous to FIG. 3 showing various exemplary embodiments.
Figure 19:
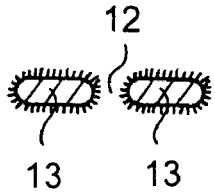
Figure 20:
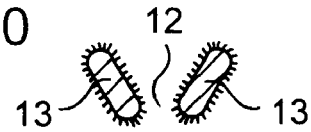
Figure 21:
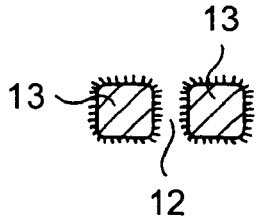

In the exemplary embodiment, the applicator element 6 may include, as shown in FIG. 5, a shape that is generally symmetrical about a midplane of symmetry M and may include a cavity 12 which is defined on sides thereof by two branches 13 and axially by distal and proximal portions 14 and 15 where the branches 13 are united. The branches may be elongate along respective longitudinal axes Y extending substantially parallel to a plane B, as shown in FIG. 4, which plane is at an angle $\alpha$ relative to the axis X of the stem 4, where the angle $\alpha$ may lie in a range of about 20° to about 30°, for example. An angle $\beta$ between each axis Y and the midplane of symmetry M may lie in a range of 5° to 45°, for example, as shown in FIG. 2.

The branches 13 and the distal and proximal portions 14 and 15 may be made by injection molding a plastics material, and may be covered in flocking.

The distal portion 14 may define a single tip centered on a median axis;

In exemplary embodiments in which the applicator element 6 projects laterally from the stem when the stem is observed along the axis of the stem, shapes of the distal and proximal portions 14 and 15 may advantageously be selected so as to make it easier to pass through the opening 11 in the receptacle 2. The proximal portion 15 may thus include edges 60 adjacent to the stem 4 that extend obliquely relative to the axis X, and the distal portion 14 may be generally tapering in shape.

In the exemplary embodiment, the branches 13 may converge toward each other on going toward the distal portion 14, and when the applicator element 6 is observed in elevation, the cavity 12 may include a shape that is substantially triangular.

For example, and as shown in FIGS. 2 and 5, for example, the cavity 12 may extend over more than one-fourth of a width b of the applicator element 6 and also over more than one-fourth of a length l thereof. Dimensions of the cavity 12 may be selected as a function of a quantity of composition that is desired to be retained optionally in the cavity 12 after the applicator has been withdrawn from the receptacle, retention being by capillarity, for example.

In the exemplary embodiment of FIG. 6, a wiper member 8 may be engaged in the neck 7. The wiper member 8 may include a collar 9 bearing against a top end edge of the neck 7, and a wiper lip 10 defining, in the exemplary embodiment, a wiper orifice 11 of circular cross-section, of diameter a, for example, substantially equal to a diameter of the stem 4. The stem may include a diameter that is generally greater than 2.5 mm, for example, being about 4 mm.

The wiper member 8 may be sufficiently flexible to allow the applicator element 6 to be extracted from the cavity 12 without deforming substantially.

The composition P in the cavity 12 may allow the applicator to be used for a relatively longer time and may also improve comfort during application by making it easier for the applicator to slide over the surface being treated.

For example, the composition P may be for application to the lips, and the user may deposit the composition on the lips by bringing a rear face 20 of the applicator 6 into contact with the lips, as illustrated in FIG. 7, for example. In the exemplary embodiment, the rear face 20 corresponds to the face situated on the rear side when the applicator element 6 is observed with the branches 13 extending forward.

During application, depending on the surface of the applicator element 6 that is in contact with the zone being treated, a thickness of the deposited composition may differ, thus enabling the user to vary the brightness of the makeup, for example.

When the applicator element 6 is applied flat, the composition P in the cavity 12 may become deposited and the surface area carrying the composition P that comes into contact with the lips may be relatively large, such that the lips may be made up quite quickly.

Where appropriate or desired, application may be performed using only the end of the distal portion 15, for example, to draw an outline.

FIG. 8 illustrates the possibility of fitting a wiper member 8 different from the member shown in FIG. 6.

In FIG. 8, the wiper member 8 maybe constituted by a block of cellular material that is elastically compressible.

The wiper member 8 may include a recess 42 passing through a center thereof that defines the opening 11 of the receptacle, as shown in FIG. 9, together with one or more slots.

A diameter of the recess 42 may correspond substantially to the diameter of the stem 4, for example.

Regardless of its cellular or other nature, the wiper member may also include one or more slots, including edges that touch or that do not touch.

FIG. 10 shows a wiper member 8 of elastomer including a central opening, for example, a circular opening together with a plurality of slots 100, which slots may be radial, the opening serving to pass the stem and the applicator element.

The applicator element 6 may be secured to the stem 4 in various ways.

In the exemplary embodiment of FIG. 1, the proximal portion 15 may be extended, as shown in FIG. 5, by an endpiece 18 that is engaged inside the stem 4.

The endpiece 18 may be secured inside the stem 4 by adhesive, by stapling, or by heat-sealing, for example. The stem may also be crimped onto the endpiece, as shown in FIG. 11.

FIG. 12 illustrates that the applicator element may be secured to the stem by snap-fastening. The endpiece 18, in this exemplary embodiment, may be configured to snap onto a head 70 formed at the end of the stem 4. An outside diameter of the endpiece 18 may then correspond substantially to that of the stem 4, for example.

In an exemplary embodiment that is not shown, the stem 4 may be snap-fastened onto the endpiece 18.

The body of the applicator element may also be made integrally, i.e., monolithically, with the stem 4, as shown in FIG. 13.

FIG. 14 illustrates the possibility for at least a portion of the applicator element 6 to extend along a longitudinal axis Z at an angle γ with the longitudinal axis X of the stem 4, the axes X and Z being contained in a common plane and the cavity 12 extending substantially parallel to the plane.

FIG. 15 illustrates the possibility of the applicator element 6 including a shape that is not symmetrical about the axis X of the stem 4. Where appropriate or desired, and as shown in FIG. 16, the applicator element 6 may include one edge 72 extending substantially in line with the stem 4.

The applicator element 6 may project laterally from the stem on a side opposite to the edge 72.

The applicator element 6 may also include more than one cavity 12, for example, two cavities 12, as shown in FIG. 17.

For example, the two cavities 12 may be in alignment on the longitudinal axis of the applicator element 6. In face view, the applicator element 6 may include a general shape of a figure eight.

In the exemplary embodiment of FIG. 1, the applicator element 6 may extend obliquely relative to the longitudinal axis X of the stem 4.

In an exemplary embodiment that is not shown, the applicator element 6 may also be elongate along a longitudinal axis that is curvilinear.

The applicator element 6 may be made differently, and each branch 13 may, for example, extend so that the longitudinal axis Y thereof is contained in a plane that is parallel to the longitudinal axis X of the stem 4.

In the exemplary embodiment of FIG. 1, for example, the cavity 12 may open to the front and to the rear of the applicator element 6, when seen in face view, as in FIG. 2.

Over at least a fraction of their length, the branches 13 may include a cross-section that is solid, for example, being circular in cross-section. FIGS. 18 to 22 illustrate various possible cross-sectional shapes for the branches 13. In an exemplary embodiment that is not shown, the branches 13 may be hollow.

Figure 22:
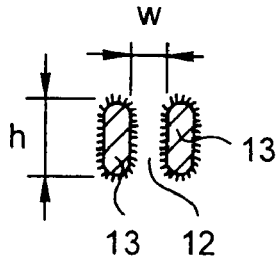

The branches 13 may, for example, include a height h that is greater than a width w of the cavity 12 between the branches, as shown in FIG. 22.

In the exemplary embodiments described above, the cavity 12 may be filled with air prior to the applicator element 6 coming into contact with the composition contained in the receptacle. That need not necessarily be the case.

Figure 23:
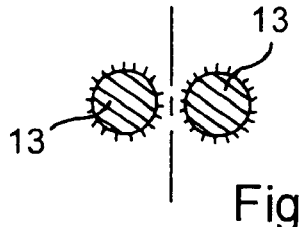

Thus, the cavity 12 may be occupied at least in part by the flocking extending from the body of the applicator element 6, as illustrated in FIG. 23. The bristles of the flocking covering the body of the applicator element may, for example, be sufficiently long for the bristles situated on the facing faces of the branches 13 to meet.

Figure 24:
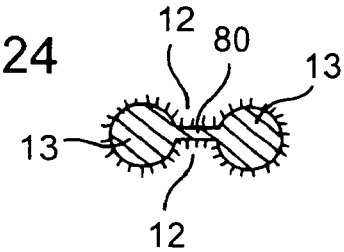

As shown in FIG. 24, the applicator element 6 may include two cavities 12 that are separated by a membrane 80 uniting the branches 13, and situated halfway across a thickness thereof, for example.

Figure 25:
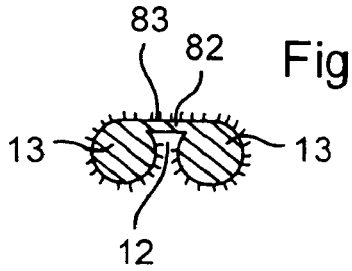

The cavity 12 may open into a single face of the applicator element 6, as shown in FIG. 25, the applicator element including a membrane 82 that defines at least part of the applicator surface by its outside face 83, for example. For example, the membrane 82 may include flocking on the outside face. In an exemplary embodiment that is not shown, at least one orifice may allow the composition contained in the cavity 12 to reach the outside face 83 through the membrane 82.

Figure 26:
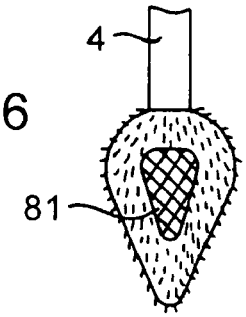
FIG. 26 is a view analogous to FIG. 2 showing another exemplary embodiment.

The membrane 80 may optionally be flocked. The membrane 80 may be replaced by a grid 81, as shown in FIG. 26.

The membranes 80 or 82 may be molded integrally, i.e., monolithically, with the branches 13.

Figure 27:
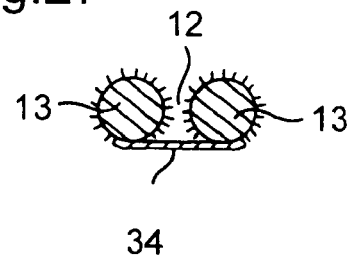

The membrane 82 may be replaced by a separate membrane 34 fitted on, as shown in FIG. 27. For example, the membrane 34 may comprise a woven or non-woven fabric, a foam, a perforated film, a grid, a felt, etc., and may be secured by heat-sealing or by adhesive, for example.

The membrane 34 may optionally be permeable to the composition P contained in the cavity 12.

The body of the applicator element 6 may be made, for example, at least in part, by injection molding a thermoplastic material, for example, polyvinylchloride (PVC), polyurethane (PU), ethylene vinyl acetate copolymer (EVA), a mixture of styrene isoprene styrene (SIS) and styrene ethylene butylene (SEB) block copolymers, nitrile, silicone, ethylene propylene diene (EPDM), Hytrel®, Pebax®, Santoprene®, or other thermoplastics, for example, elastomers.

The applicator element 6 may also be made of non-thermoplastic materials, for example, resins, for example, flexible resins, or may be made other than by molding, for example, by being cut out.

Figure 28:
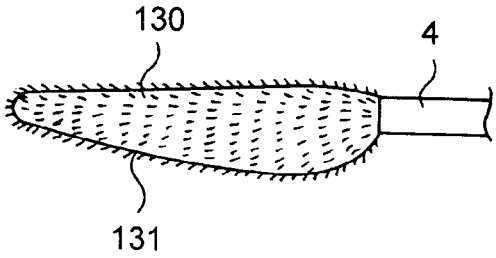
FIG. 28 is a side view of another exemplary applicator element.
Figure 29:
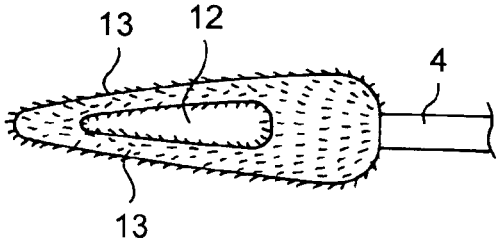
FIG. 29 shows the applicator element of FIG. 28 as seen from above.

FIGS. 28 and 29 show an exemplary applicator element 6 including top and bottom faces 130 and 131 that converge toward the distal end of the applicator element, at least along a portion of the cavity 12.

The longitudinal axis X of the stem 4 may be, for example, substantially parallel to one of the faces 130 and 131, for example, to the top face 130.

In the exemplary embodiment, the applicator element 6 may also include, when observed from above as shown in FIG. 29, longitudinal edges that are substantially rectilinear and that converge toward the distal end.

The applicator elements shown in FIGS. 30 to 45 may advantageously be used for applying a composition, a makeup or a care product, onto keratinous fibers, for example, eyelashes or eyebrows.

In such applicator elements, the single cavity 12 may be elongate in shape, with a ratio of a length m of the cavity to a greatest width n of the cavity being, for example, greater than or equal to 3, or 4, or 5, or 6. For example, $3 \leqq m/n \leqq 6$.

Figure 30:
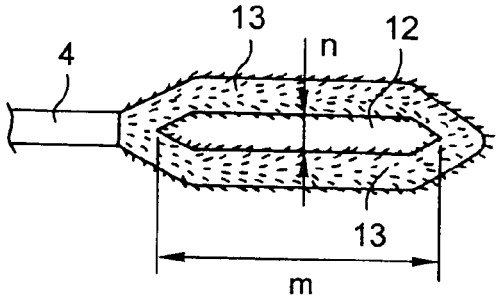

FIG. 30 shows an exemplary applicator element including a cavity 12 that is substantially constant in width over at least half of its length. Longitudinal edges of the branches 13 may be rectilinear and mutually parallel, on either side of a middle portion situated halfway along the cavity, for example.

Figure 31:
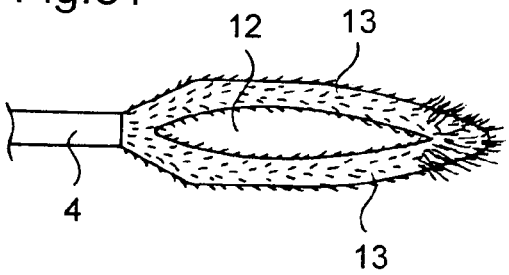

In the exemplary embodiment of FIG. 31, the applicator element 6 maybe flocked, and a distal portion thereof may be covered by bristles that are longer than those covering the branches 13. The distal portion may be used, for example, for applying makeup to a corner of an eye.

Figure 32:
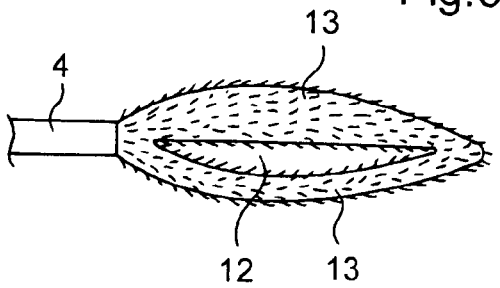

In the exemplary embodiment of FIG. 32, the branches 13 may be of unequal widths, and the cavity 12 may be off-center.

In the exemplary embodiment of FIG. 33, the longitudinal edges of the branches 13 may appear to be grooved, when the applicator element is observed from above.

FIG. 34 illustrates that it is possible for the branches 13 of the applicator element to include longitudinal edges that are outwardly concave. The cavity may then include a width that passes through a minimum between two axial ends thereof.

In the exemplary embodiment of FIG. 35, the longitudinal edges of the branches may be outwardly convex, and the cavity 12, when observed from above, may be lens-shaped.

The exemplary applicator element shown in FIG. 13 may include a longitudinal axis Y that is curvilinear, and a free end of the applicator element may not lie on the longitudinal axis X of the stem. One of the branches may include an outwardly-convex outside edge, while the other branch may include an outwardly-concave outside edge.

The applicator element of FIG. 37 may include a branch including an outwardly-convex outside edge and another branch including a rectilinear outside edge. In addition, the cavity 12 may be relatively narrow and form a capillary slot, as shown.

In the embodiment of FIG. 38, the cavity 12 may be larger than in the exemplary embodiment of FIG. 37, and may include a width that varies, passing through an extremum.

Figure 39:
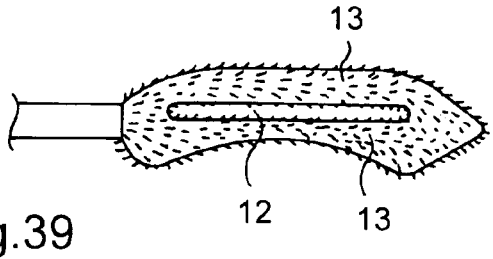

FIG. 39 illustrates the possibility for the applicator element to include two branches, one of which may include a rectilinear outside edge and the other of which may include an outside edge that is concave toward the outside.

Figure 40:
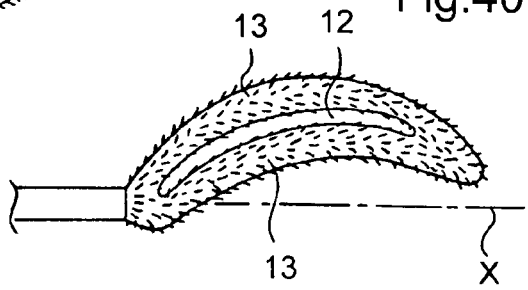

In the exemplary embodiment of FIG. 40, the applicator element may include a curvilinear longitudinal axis, as in the exemplary embodiment of FIG. 36, and the free end of the applicator element may be situated on a same side of the longitudinal axis X of the stem as practically all a remainder of the applicator element.

Figure 41:
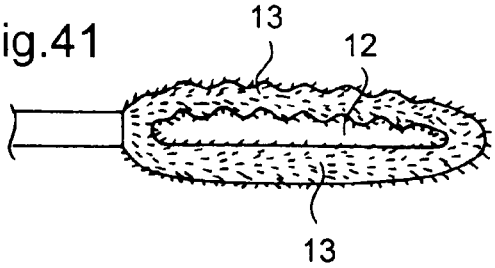

FIG. 41 illustrates the possibility for one of the branches of the applicator element to include grooves while the other branch does not include any. The grooves may extend transversely to the branch, for example.

Figure 42:
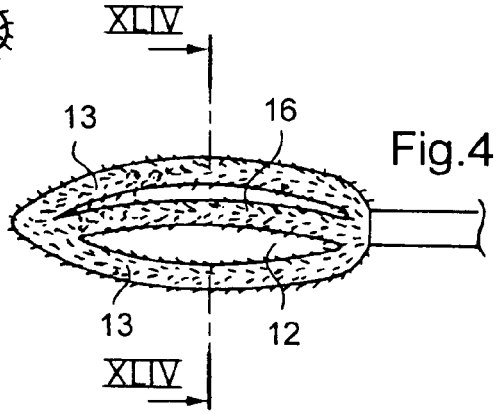
FIGS. 42 and 43 are diagrammatic perspective views of exemplary applicator elements including three branches.
Figure 43:
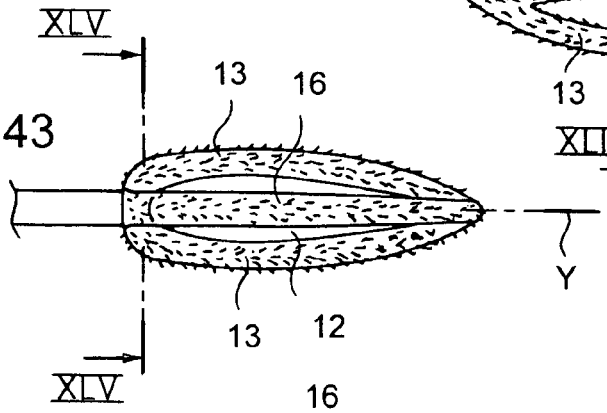

FIGS. 42 and 43 show applicator elements each including a third branch 16 interconnecting the distal and proximal portions of the applicator element.

Figure 44:
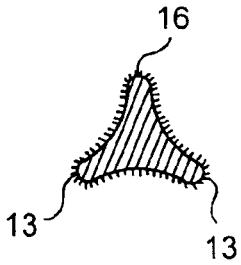

In the exemplary embodiment of FIG. 42, the third branch may be situated on one side of a plane defined by the longitudinal axes of the other two branches 13, as shown in FIG. 44. For example, the branch 16 may be arcuate in shape.

Figure 45:
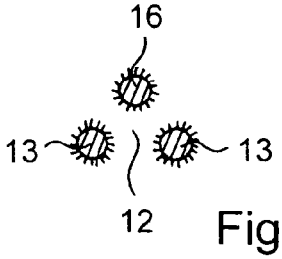
FIGS. 44 and 45 are cross-sectional views taken along XLIV and XLV in FIGS. 42 and 43, respectively.

In the exemplary embodiment of FIG. 43, the two branches 13 and the third branch 16 may be disposed regularly around the longitudinal axis Y of the applicator element, the proximal portion of the applicator element including a cross-section that is generally triangular in shape or in the form of a three-branch star, as shown in FIG. 45.

Figure 46:
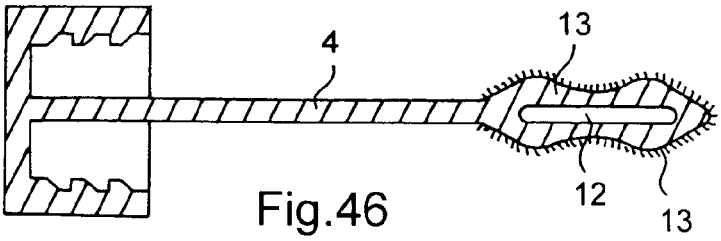
FIG. 46 is a longitudinal cross-sectional view of another exemplary applicator.

FIG. 46 illustrates that it is possible to make the body of the applicator element integrally, i.e., monolithically, with the stem and with the handle member, which may also serve as a member for closing the receptacle.

The applicator elements of FIGS. 30 to 45 may be, for example, made at least in part by molding a material, for example, a thermoplastic material.

The applicator elements of FIGS. 30 to 45 may be used to load a relatively large quantity of composition onto eyelashes. Two branches of the applicator element may be used simultaneously or in succession for applying composition to eyelashes.

For all of the applicator elements described above, the composition may, where appropriate or desired, be applied in a variety of ways depending on a looked-for result, with the applicator element being used flat, or on its edge, or at various angles of inclination, for example, with the orientation selected by the user serving to determine an intensity of the makeup and possibly also to comb the eyelashes, for example.

The applicator element may include shapes other than those shown. For example, the applicator element may be in a shape of a lozenge, a circle, or an ellipse when observed in face view.

The applicator elements may include magnetic particles so as to be capable of attracting magnetic fibers contained in the composition, for example.

In exemplary embodiment in which the applicator element is deformable, advantage may be taken of its deformability to recover the composition that adheres to an inside surface of the receptacle. An applicator element that is clearly elongate in shape, as is the case for the exemplary applicator elements shown in FIGS. 29 to 43, for example, may advantageously be made so as to enable such deformation to be performed.

Naturally, the invention is not limited to the embodiments described above. For example, the characteristics of the various embodiments may be combined with one another.

All of the applicator elements described above, and for example, those described with reference to the drawings, may be used without the applicator element being deformed between being loaded with the composition and being used to apply the composition, as may be the case, for example, when applicator elements are used in association with a supply of composition that is contained other than in a receptacle provided with a neck.

In such exemplary embodiments, the applicator stem need not include a handle element 5.

Figure 47:
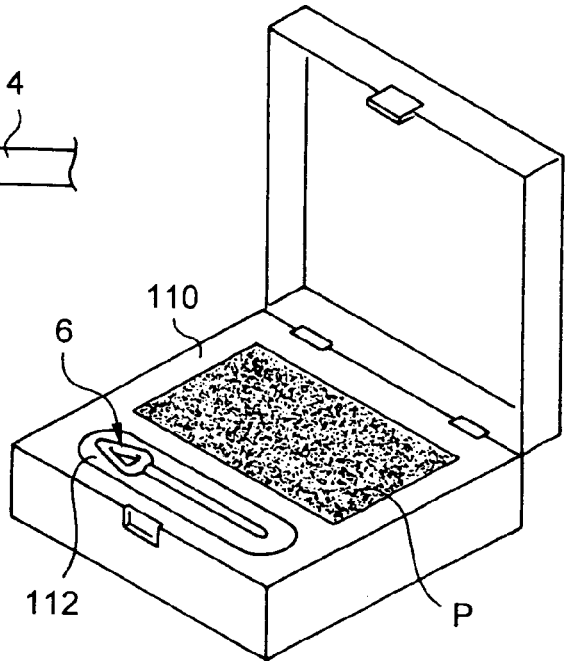
FIG. 47 shows an exemplary makeup applicator set.

For example, the composition P may be contained in the form of a paste, a compact powder, or a free or other powder, in a cup in a box 110, as shown in FIG. 47.

The applicator may be received in a corresponding housing 112 formed in the box.

The applicator element may be loaded with composition by being brought into contact therewith. The applicator element may be optionally deformed while being loaded with composition.

FIGS. 48 to 51 show another exemplary applicator member.

By comparison to the exemplary embodiment of FIG. 1, the applicator member of FIGS. 48 to 51 may include a more tapering shape when seen from the side as in FIG. 50.

The angles $i_1$, $i_2$ and $i_3$ may range, for example, respectively between 6 and 16°, $i_1$ being, for example, close to 11°, 17,7 and 27,7, i2 being, for example, close to 20,7, and 25,4 and 35,4, i3 being, for example, close to 30,4°.

The front face 200 and rear face 20 may taper toward the distal end 201 of the applicator element, being, for example, substantially planar.

The sides of the applicator element may be curved both in a cross-section in a plane perpendicular to the axis Y and when seen from top or bottom as in FIGS. 48 and 49. A height of the cavity 12, measured perpendicularly to the axis Y, may vary on at least half a length of the cavity.

The length of the cavity 12, measured along the axis Y, may be less than or equal to 20 mm, or may be greater than 20 mm.

The cavity 12 may include a width that varies on more than half of a length of the cavity.

When an applicator element, such as one of those described above, is used with an associated wiper member 8, the wiper member may be variable as shown on FIG. 52. In such a case, the receptacle 2 may include at least two parts 2*a* and 2*b* which are movable one with respect to one another so as to exert a constraint on the wiper member and, for example, such that the section of the opening of the wiper member vary.

In the exemplary embodiment of FIG. 52, the receptacle may comprise a projection 210 extending beyond the neck which presses on the wiper member so as to open more or less the wiper member.

For a given adjustment of the wiper member, the opening of the wiper member may be small enough to exert a constraint on the applicator element, and the applicator element may deform when passing through the wiper member.

For a different adjustment of the wiper member, a size of the opening of the wiper member may be large enough so that the applicator element does not suffer any constraint when passing through the wiper member, or may suffer a constraint that does not lead to a substantial deformation of the cavity 12.

Of course, the present invention is not restricted to specific means to vary the opening of the wiper member.

FIG. 53 illustrates the possibility for the wiper member 8 to comprise an undulated wiping lip including undulations 220 that enable the lip to unfold when the applicator element passes therethrough. This may avoid exerting a constraint on the applicator that would lead to a substantial deformation of the cavity 12.

The undulations may, for example, comprise hollows and projections along a circumferential direction around the opening of the wiper member.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

The term "comprising a" should be understood as being synonymous with "comprising at least one", unless specified to the contrary.

What is claimed is:

1. A packaging and applicator device comprising:

a receptacle containing a composition for application; and an applicator for applying the composition, the applicator comprising:

a stem; and an applicator element at one end of the stem, the applicator element projecting laterally from the stem, the applicator element including:

at least two branches consisting of plastic material; and a flocking material surrounding at least one of the at least two branches, wherein distal ends of the branches meet to form only one convergent pointed tip, defining between the branches a cavity that is open to the outside via at least one face of the applicator element, the cavity being elongate in shape and extending along the branches, the plastic material of the at least two branches being sufficiently rigid to prevent the cavity from deforming substantially between a moment when the applicator element leaves the composition and a moment when the composition is applied.

2. A device according to claim 1, wherein the cavity opens via two opposite faces of the applicator element.

3. A device according to claim 1, wherein the cavity includes an outline that is closed, in at least one plane.

4. A device according to claim 1, wherein the cavity extends substantially parallel to a plane forming a non-zero angle with a longitudinal axis of the stem to which the applicator element is connected.

5. A device according to claim 1, wherein at least a portion of the applicator element is elongate along a longitudinal axis that forms a non-zero angle with a longitudinal axis of the stem to which the applicator element is connected.

6. A device according to claim 1, wherein the receptacle includes a wiper member.

7. A device according to claim 6, wherein the wiper member comprises an elastomer wiper member.

8. A device according to claim 6, wherein the wiper member comprises an undulating lip that is configured to unfold when the applicator element passes therethrough.

9. A device according to claim 6, wherein the wiper member comprises an adjustable wiper member.

10. A device according to claim 6, wherein the wiper member is secured in a neck of the receptacle.

11. A device according to claim 1, wherein the applicator element is symmetrical in shape about a midplane.

12. A device according to claim 11, wherein the midplane contains a longitudinal axis of the stem to which the applicator element is connected.

13. A device according to claim 1, wherein the stem that carries the applicator element is connected at an end opposite to the applicator element to a cap configured to close the receptacle.

14. A device according to claim 13, wherein the applicator element includes a fastener endpiece engaged in the stem.

15. A device according to claim 13, wherein the stem includes an outside diameter that is not less than 2.5 mm.

16. A device according to claim 13, wherein the applicator element is fitted to the stem.

17. A device according to claim 13, wherein the applicator element is molded with the stem.

18. A device according to claim 1, wherein the cavity extends over more than half a length of the applicator element.

19. A device according to claim 1, wherein a width of the cavity is less than a width of the two branches together.

20. A device according to claim 1, wherein, prior to any contact with the composition, the cavity is filled with air.

21. A device according to claim 1, wherein the cavity in plan view includes a shape that is substantially triangular.

22. A device according to claim 1, wherein at least a distal end portion of the applicator element is flocked.

23. A device according to claim 1, wherein an entire surface of the applicator element configured to apply the composition is flocked.

24. A device according to claim 1, wherein the applicator element includes a cross-section of generally rectangular shape.

25. A device according to claim 1, wherein the composition is configured to make up at least one of mucous membranes, skin, and nails.

26. A device according to claim 25, wherein the composition comprises a lipstick.

27. A device according to claim 1, wherein the composition comprises a mascara.

28. A device according to claim 1, wherein, when the applicator element is observed in a direction substantially perpendicular to a plane of the cavity, an area of the cavity comprises at least 15% of an area defined by an outline of the applicator element.

29. A device according to claim 28, wherein the area of the cavity lies in a range of 15% to 50% of the area defined by the outline of the applicator element.

30. A device according to claim 1, wherein, in cross-section, one of the branches includes a shape that is round, at least in part.

31. A device according to claim 1, wherein at least one of the branches includes a cross-section that is one of circular, oval, and elliptical in shape.

32. A device according to claim 1, wherein the cavity includes a maximum length that is greater than a diameter of the stem.

33. A device according to claim 1, wherein at least two branches of the applicator element include shapes that are different.

34. A device according to claim 1, wherein the cavity includes a shape that is elongate, with a ratio m/n that is not less than 3, where m designates a length of cavity and n designates a greatest width thereof .

35. A device according to claim 34, wherein the ratio m/n is not less than 6.

36. A device according to claim 1, wherein an outside edge of at least one of the branches is grooved, at least in part.

37. A device according to claim 1, wherein the applicator element includes flocking bristles including at least one of lengths and diameters that are different.

38. A device according to claim 1, wherein the applicator element includes flocking bristles of different materials.

39. A device according to claim 1, wherein the applicator element includes magnetic properties.

40. A device according to claim 1, wherein the cavity is a single cavity.

41. A device according to claim 1, wherein the branches are molded together of a thermoplastic material.

42. A device according to claim 1, comprising injection-molded plastics material.

43. A device according to claim 1, wherein a width of the applicator element increases from the stem, at least on a portion of a length of the applicator member.

44. A device according to claim 1, wherein a width of the applicator element is greater than a diameter of the stem.

45. A device according to claim 1, wherein the only one tip is centered on a median axis.

46. A device according to claim 1, wherein the cavity traverses the applicator element on more than half of the applicator element.

47. A method of making up at least one of skin and lips, comprising:

applying a composition to the skin or lips using the applicator of a device as defined in claim 1, without substantially deforming the cavity between a moment when the applicator element leaves the composition and a moment when the composition is applied.

* * * * *